US005657693A

United States Patent [19]

Kumaki et al.

[11] Patent Number: 5,657,693

[45] Date of Patent: Aug. 19, 1997

[54] APPARATUS FOR CLEANING PRINTING CYLINDER

[75] Inventors: Tuneo Kumaki, Omiya; Shozabu Inuyama, Urawa; Naoyuki Suga; Isamu Zensho, both of Warabi; Kazuo Fukuda, Ageo, all of Japan

[73] Assignee: JPE Co., Ltd., Saitama-ken, Japan

[21] Appl. No.: 607,200

[22] Filed: Feb. 26, 1996

Related U.S. Application Data

[63] Continuation of Ser. No. 428,478, Apr. 27, 1995, abandoned, which is a continuation of Ser. No. 186,867, Jan. 27, 1994, abandoned.

[30] Foreign Application Priority Data

Jan. 29, 1993 [JP] Japan ..... 5-013381
Oct. 13, 1993 [JP] Japan ..... 5-255401

[51] Int. Cl.[6] ..... B41F 35/00

[52] U.S. Cl. ..... 101/424; 101/423

[58] Field of Search ..... 101/424, 423, 101/425

[56] References Cited

U.S. PATENT DOCUMENTS

| | | | |
|---|---|---|---|
| 1,196,437 | 8/1916 | Doyle | 101/425 |
| 1,378,278 | 5/1921 | Roberts | 101/423 |
| 4,686,902 | 8/1987 | Allain et al. | 101/424 |
| 4,875,412 | 10/1989 | Wright et al. | 101/423 |
| 5,259,313 | 11/1993 | Gibson et al. | 101/425 |
| 5,265,537 | 11/1993 | Gasparrini et al. | 101/423 |

FOREIGN PATENT DOCUMENTS

| | | | |
|---|---|---|---|
| 0004948 | 1/1988 | Japan | 101/425 |
| 0895125 | 10/1959 | United Kingdom | 101/425 |

*Primary Examiner*—Edgar S. Burr
*Assistant Examiner*—Anthony H. Nguyen
*Attorney, Agent, or Firm*—Armstrong, Westerman, Hattori, McLeland & Naughton

[57] ABSTRACT

An apparatus for cleaning printing cylinder comprising a cleaning head 3 is disposed in parallel to the printing cylinder so as to be attachable and dettachable to the overall width thereof, and the cleaning is carried out by pressing said cleaning head 3 against the printing cylinder 1. The cleaning head 3 comprises a cleaning case 9 having a suction port 8 at the upper part thereof and a wind chest 10. The interior of the cleaning case 9 is partitioned into the front 11, the rear 12, and the middle part 13 with respect to the direction of the rotation of the printing cylinder 1, with the front 11 and the rear 12 being, respectively, fitted with cleaning members 14, 15 and the middle part 13 being fitted with a lip 16 composed of an elastomeric material. Between the lip 16 and the front 11 and beneath the rear 12 there are formed slits 17, 18 which have suitable gaps, and both of them communicate with the wind chest 10. The cleaning is carried out by supplying the cleaning liquid from the supply port 19 to the cleaning members 14, 15. The air carrying the waste cleaning liquid is collected in the wind chest 10 through the slits 17, 18 and sucked by a vacuum apparatus.

4 Claims, 8 Drawing Sheets

APPARATUS FOR CLEANING PRINTING CYLINDER

This application is a continuation of application Ser. No. 08/428,478 filed Apr. 27, 1995, now abandoned, which was a continuation of application Ser. No. 08/186,867 filed Jan. 27, 1994, now abandoned.

BACKGROUND OF THE INVENTION

1. Field of the Invention

The present invention relates to an apparatus for cleaning various kinds of printing cylinders such as the blanket cylinder, impression cylinder, etc. of an offset press.

2. Prior Art

On printing with offset presses any foreign matter such as ink, paper dust, powder, dirt, etc. is very often found to adhere to the surface of the printing cylinder. Since such foreign matter is apt to deteriorate the quality of the printed products, in order to maintain such quality at high levels it is necessary to remove the above-described foreign matter adhered to the cylinder surface by frequently cleaning the surface of the printing cylinder during the preparation for the printing work or during the printing operation. Further, when the printing work is complete, the surface of the printing cylinder should be completely cleaned to remove the ink adhered thereto. For this purpose, prior art adopts cleaning systems such as a brush cleaning system, a wiping off system using non-woven fabric, a cleaning head system etc. Among them, as for the cleaning head system, the present applicant has already proposed the one shown in Japanese Patent Laying-open No. 77412/1993.

Although the system shown in Japanese Patent Laying-open No. 77412/1993 possesses many merits, the cleaning head is of a traveling type in which the traveling time becomes longer as the size of the printing machine is increased and hence the overall width of the printing cylinder is alsos increased, so that there was a problem that the cleaning, in general, takes a long time. On the other hand, an attempt to shorten the cleaning time by increasing the width of the cleaning head showed that since the required amount of air cannot be secured it is unreasonable from the structural viewpoint. In order to solve this problem the present applicant has proposed in Japanese Patent Application No. 13381/1993, an apparatus for cleaning printing cylinder in a cleaning a head system of a fixed type having a suction port.

The above-described proposal is found to be outstandingly effective in the case where use is made of an ink which is especially difficultly soluble in the cleaning liquid such as, for example, UV ink, or the like. Whereas, in the case of use of an ordinary ink, or the like, comparatively easily soluble in the cleaning liquid, the amount of the exhaust air so much increases that the cost of equipment runs up, the structure of the cleaning head is inevitably complicated, and the floor space to install becomes larger.

Further, in order that the cleaning liquid may be uniformly spread over the whole surface of the cleaning member it is necessary that the space between the supply tubes should be taken to be small, and since the amount of the cleaning liquid used should be as small as possible from the standpoint of the cost, it often happens that the supply pressure to the supply tubes becomes almost zero, in which case it is considerably difficult to make the amount of the liquid injected from the supply tubes uniform over the whole surface. In order to avoid this, it is necessary that the inside diameter of the nozzles of the supply tubes is made small (for example, less than 0.2 mm), but this was a problem in the fabrication.

SUMMARY OF THE INVENTION

The apparatus for cleaning a printing cylinder of a printing machine of the present invention is the one wherein the cleaning is carried out by pressing against the surface of the rotating printing cylinder a cleaning head which is disposed in parallel to the central axis of said printing cylinder so as to be attachable and detachable to the overall width of said printing cylinder, which is characterized in that said apparatus for cleaning is provided with a cleaning head which comprises cleaning members for cleaning by supplying the cleaning liquid, lips for scraping off the waste cleaning liquid, and slits and a wind chest for discharging the waste cleaning liquid.

Further, the apparatus for cleaning a printing cylinder of a printing machine of the present invention of a second embodiment is characterized in that said cleaning head comprises a cleaning case, a suction port, and a wind chest, and the interior of said cleaning case is partitioned into the front, the rear, and the middle part with respect to the direction of the rotation of the printing cylinder, with said front and rear being, respectively, fitted with a cleaning member and said middle part being fitted with a lip; and further, said cleaning head is not only provided with a means for pressing against the surface of said printing cylinder said cleaning member along with the front end of said lip, a means for supplying the cleaning liquid to said cleaning members of said front and rear, and a means for making air flow in from said suction port and from beneath said cleaning case, but also designed in such a way that upper and lower slits which communicate, respectively, with said wind chest are formed between said lip and said front and beneath the rear.

Further, the apparatus for cleaning a printing cylinder of a printing machine of the present invention of a third embodiment is characterized in that said cleaning head comprises a cleaning case, a suction port, and a wind chest, and the interior of said cleaning case is partitioned into the front and the rear with respect to the direction of the rotation of said printing cylinder, with said front being fitted with a cleaning member and said rear being fitted with a lip, and further, said cleaning head is not only provided with a means for pressing against the surface of said printing cylinder said cleaning member along with the front end of said lip, a cleaning liquid supplying means for supplying the cleaning liquid to said cleaning member in said front, and a means for making air flow in from said suction port, but also designed in such a way that upper and lower slits which communicate, respectively, with said wind chest are formed between said lip and said front and beneath the rear.

Further, the apparatus for cleaning a printing cylinder of a printing machine of the present invention of a fourth embodiment is characterized in that said cleaning liquid supplying means which possesses a supply tube which is made of an elastomeric material and has a circular shape in cross-section can regulate the amount to be supplied in such a way that by making nozzle holes of a very fine diameter at definite intervals on said supplying tube the supply pressure of said cleaning liquid is changed.

Action

To begin with, the action of the second embodiment will be explained. When the cleaning head of the cleaning apparatus is brought in contact with the printing cylinder, any foreign matter such as ink, paper dust, dirt, powder, etc. adhered to the surface of the printing cylinder is introduced in between the surface of the printing cylinder and the cleaning members fitted in the front and the rear of the cleaning case. On the other hand, to the cleaning members cleaning liquid is supplied from the cleaning liquid supplying means, and cleaning is carried out therein. The cleaning is carried out firstly as the preliminary cleaning at the front of the cleaning case. By this cleaning the waste cleaning liquid containing most of the foreign matter is scraped off by the lip and sent to the wind chest through the upper slit by the air flowing in, which is provided from the suction port opening at the upper part of the cleaning case. Then, the waste cleaning liquid containing the foreign matter which can not be scraped off by the lip is sent to the rear, where the finishing cleaning is carried out by the supply of fresh cleaning liquid, and the resulting waste cleaning liquid is sent to the wind chest through the lower slit by the air flowing in, which is provided from the gap between the lower part of the cleaning case and the printing cylinder. The air and the waste cleaning liquid collected in the wind chest are sucked for recovery by means of a vacuum apparatus. Thus, the printing cylinder can be cleaned sufficiently in a short period of time by the cleaning liquid.

Next, the action of the third embodiment will be explained. The cleaning is carried out firstly at the front of the cleaning case, and the resulting waste cleaning liquid containing the foreign matter is scraped off by the lip at the rear and sent to the wind chest through the upper slit by the air flowing in, which is provided from the suction port opening at the upper part of the cleaning case. On the other hand, one portion of the waste cleaning liquid which has been scraped off by the lip but remained at the front edge of the gap of the printing cylinder is sent to the wind chest through the lower slit by the stream of the air which is provided through the gap while the lip is passing the gap of the printing cylinder. Thus, the air and the waste cleaning liquid collected in the wind chest are sucked by a vacuum apparatus, and the printing cylinder is cleaned sufficiently in a short period of time.

Since the first and second embodiments of the present invention, as compared with the conventional traveling type of cleaning head system, adopted the fixed type, the time required for the cleaning can be shortened by a large margin, and also, by the adoption of the suction port, it is possible in the upper slit to secure an almost definite amount of air stream at any time including the time when the cleaning head passes through the gap of the printing cylinder, so that the amount of the waste cleaning liquid remaining in the gap can be reduced. And also, by partitioning the cleaning case into the upper part, the lower part, and the middle part the two stages of preliminary cleaning and finishing cleaning can be performed, which improves the cleaning effect, and thus, even in the case where the UV ink, or the like, difficultly soluble in the cleaning liquid is used and is to be cleaned, the cleaning effect may be well expected.

Further, since in the cleaning in the case where use is made of an ordinary ink, etc. that are comparatively easily soluble in the cleaning liquid the amount of the cleaning liquid remaining on the surface of the printing cylinder or at the end of the gap is extremely small, the third embodiment of the present invention is advantageous in the reduction of the paper loss or the prevention of the paper break. Furthermore, it is also structurally simple and easily maintainable without the necessity of a large space, and a lesser amount of the exhaust air as well as no large power consumption will suffice for the vacuum apparatus. Accordingly, it is suited for the application to the apparatus for cleaning a printing cylinder, for which a sufficiently large floor space to install cannot be obtained. It has also a merit in that the cost of equipment can be saved.

DETAILED DESCRIPTION AND THE PREFERRED EMBODIMENTS

Figure 1:
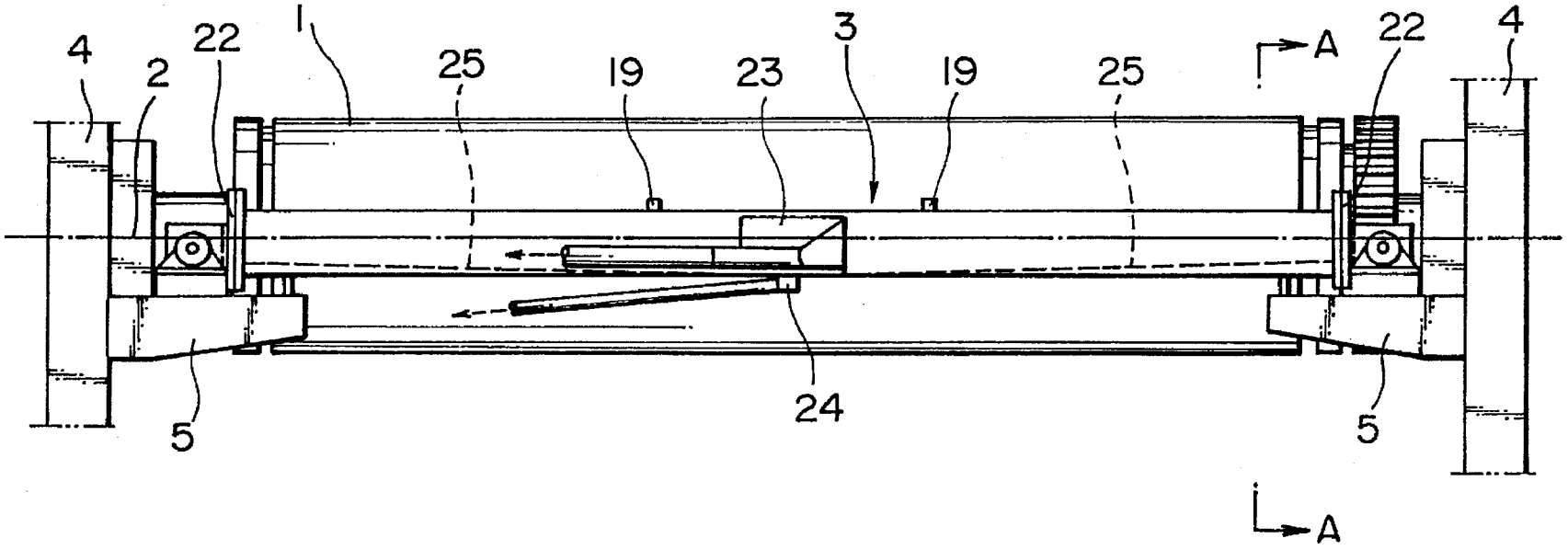
FIG. 1 is a front view of Example 1 showing an apparatus for cleaning printing cylinder.
Figure 2:
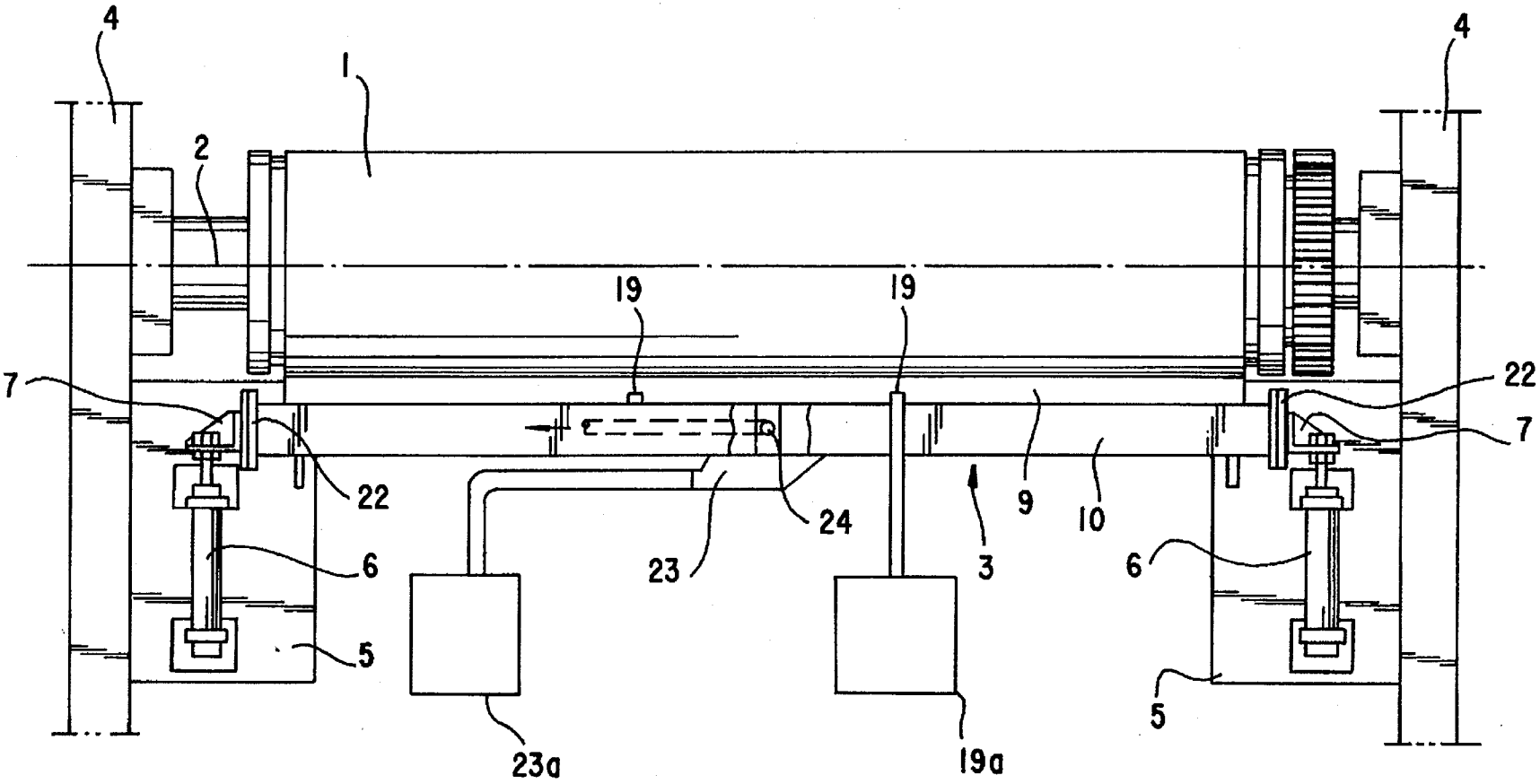
FIG. 2 is a plan showing Example 1 in FIG. 1.
Figure 3:
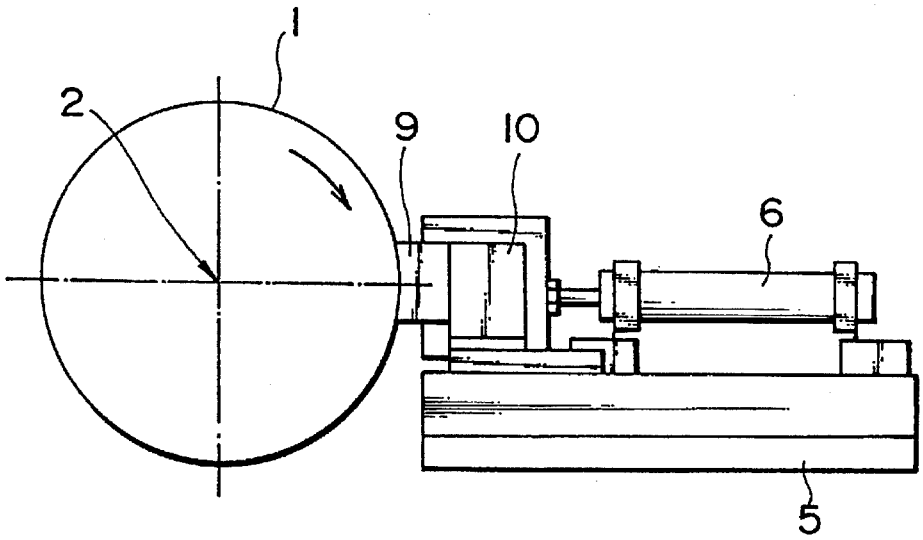
FIG. 3 is an enlarged cross-sectional view taken along A—A line of FIG. 1.
Figure 4:
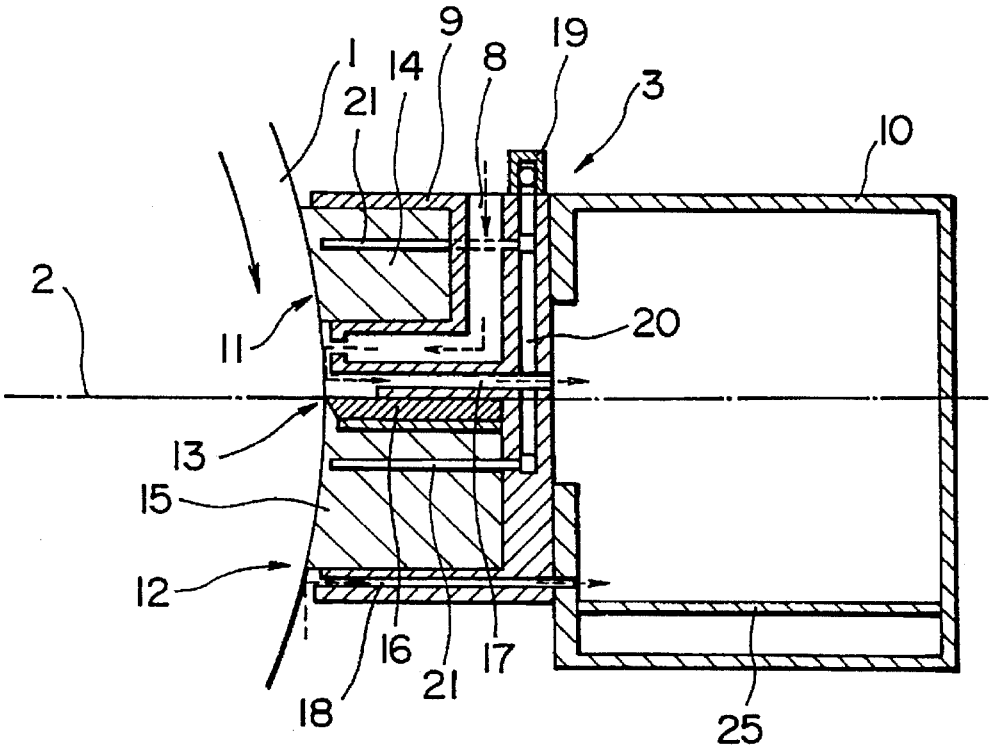
FIG. 4 is an enlarged cross-sectional view of the cleaning head in FIG. 3.

With reference to FIGS. 1–4, Example 1 the second embodiment of the present invention will be explained below. As shown in FIGS. 1–4, the cleaning is carried out by designing the apparatus in such a way that the cleaning head 3 which is disposed in parallel to the central axis 2 of the printing cylinder 1 so as to be attachable and detachable to the overall width of said printing cylinder 1 is pressed against the surface of the rotating printing cylinder 1.

On the brackets 5 fixed to the body frames of the printing machine on both sides there are mounted air cylinders 6 being operated by compressed air. Said cleanning head 3 is attachable and detachable i.e., contort, when desired the surface of the printing cylinder 1 by operating the air cylinder 6 by the aid of gussets 7. The contact pressure to the surface of the printing cylinder 1 can be suitably regulated by means of a regulating device (not shown in the figure). Said cleaning head 3 comprises a cleaning case 9, which possesses a suction port 8 at the upper part, and a wind chest 10. The interior of the cleaning case 9 is partitioned into the front 11, the rear 12, and the middle part 13 with respect to the direction of the rotation of the printing cylinder 1, with the front 11 and the rear 12, respectively, being fitted with or occupied by cleaning members 14, 15 consisting of sponge and the middle part 13 being fitted with a lip 16 composed of an elastomeric material such as hard rubber. In the case where the overall width of the cleaning case 9 is long, the lip 16 may be provided with the adjusting mechanism for uniformly pressing the front end of the lip 16 against the surface of the printing cylinder 1. Further, between the lip 16 and the front 11 and beneath the rear 12 there are formed, respectively, slits 17 and 18 which possess suitable gaps, and both of them are communicated with said wind chest. 10.

At the upper part of the above-described cleaning case 9 there is provided a cleaning liquid supply port 19, and the cleaning liquid sent from the cleaning liquid supplying device 19*a* is supplied to the cleaning members 14 and 15 through supply tubes 20, 21. Thus, the foreign matter such as ink, paper dust, powder, etc. adhered to the surface of the printing cylinder 1, but introduced in the cleaning head, can be cleaned by this cleaning liquid.

The above-described wind chest 10 is of such a structure that both side faces thereof are made to be blind boards 22 freely removable for the convenience of maintenance. The air collected in said wind chest 10 through said slits 17 and 18 is sucked by a vacuum apparatus 23*a* from a discharging port 23 at the front of the middle part. In addition, in the case where the width of the above-described cleaning head 3 is short, the discharging port 23 may be provided on either of both sides. The single flow of the air in the direction of the width from said slits 17 and 18 impedes the discharging of the waste cleaning liquid, which leads to the lowering of the cleaning effect. The single flow increases as the width of said cleaning head 3 increases, though it relates also to the flow rate of the air within said wind chest 10. For this reason the cross sectional area of the wind chest 10 is chosen so as to suppress the flow rate to the order giving no influence upon the cleaning effect.

Further, the inclined bottom face boards 25 in the interior of said wind chest 10 are inclined facing the central bottom part from both sides of said wind chest 10 and the waste cleaning liquid collected within said wind chest 10 through said slits 17 and 18 is carried to the discharging port 24 at the central bottom part for collection by the air blowing coupled with the gravitational fall, and sucked along with the air by the above described vacuum apparatus (not shown in the figure).

Next, the operation of Example 1 the first embodiment will be explained. When the printing machine is printing or in the state of having finished printing, the cleaning head 3 is in the state detached from the surface of the printing cylinder 1. When cleaning is carried out, firstly the printing cylinder 1 is rotated, and the air cylinders 6 are actuated by elongation so as to bring the cleaning head 3 into contact with the printing cylinder 1. Concurrently with this the vacuum apparatus and the cleaning liquid supplying device are also actuated, whereby the supply of the cleaning liquid and the treatment of the waste cleaning liquid are performed. In this cleaning the cleaning liquid and water may be supplied either in the form of an emulsion or separately one after the other. When the cleaning is started and the above-described vacuum apparatus is operated, the atmospheric air is sucked from the suction port 8 at the upper part of the cleaning case 9 as shown by the arrow of broken line in FIG. 4, and the waste liquid scraped off by the lip 16 is transported by air to the wind chest 10 through the slit 17. On the other hand, from beneath the cleaning case 9 also the atmospheric air is sucked as shown by the arrow of broken line in FIG. 4, and the waste cleaning liquid which has finished cleaning at the rear 12 is transported by air to the wind chest 10 through the slit 18. The waste liquid sucked by the above-described vacuum apparatus is recovered by the waste liquid recovering device (not shown in the figure).

If the surface of the printing cylinder 1 has been finely cleaned after the lapse of a suitable period of time, the supply of the cleaning liquid alone is stopped, and while operating the vacuum apparatus as it is, the remaining cleaning liquid is thoroughly scraped off. Thereafter, by actuating the air cylinders 6 the cleaning head 3 is detached from the printing cylinder 1, and by stopping the vacuum apparatus the cleaning is finished.

Figure 5:
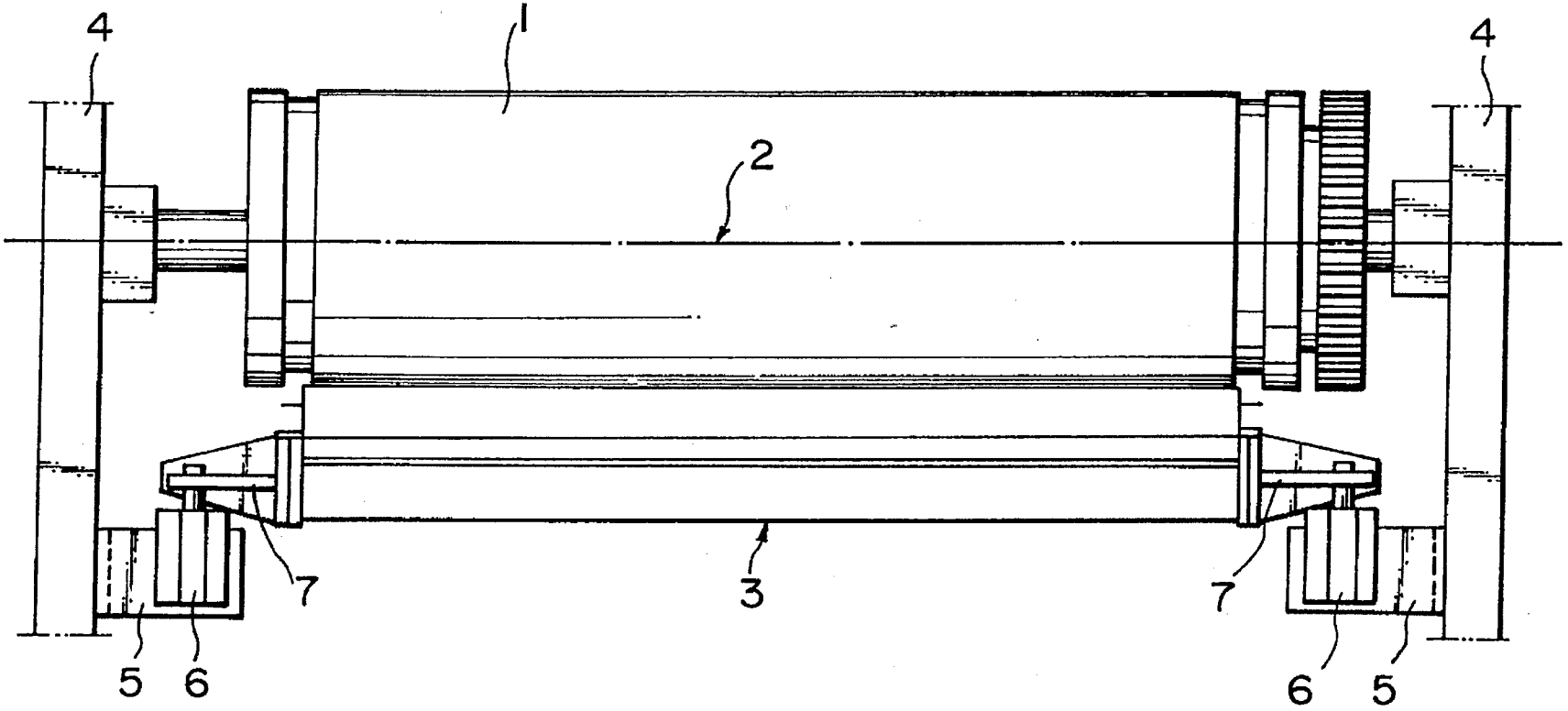
FIG. 5 is a plan showing Example 2 of an apparatus for cleaning printing cylinder.
Figure 6:
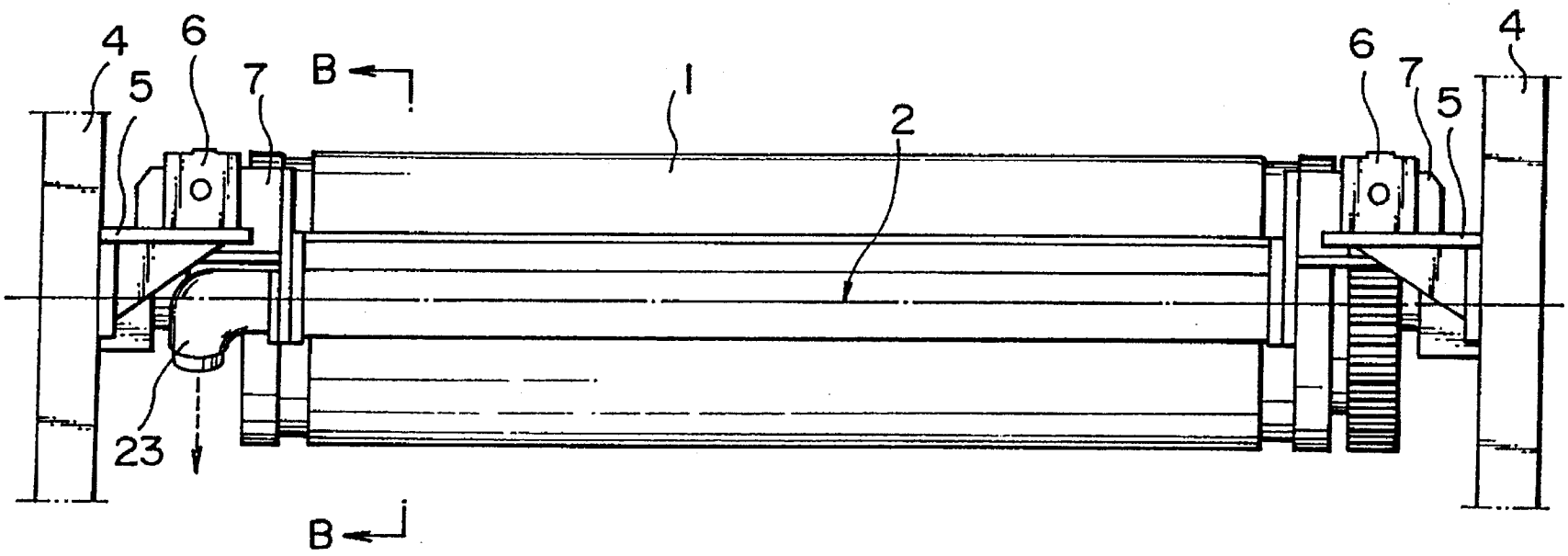
FIG. 6 is an elevation showing Example 2 of an apparatus for cleaning printing cylinder.
Figure 7:
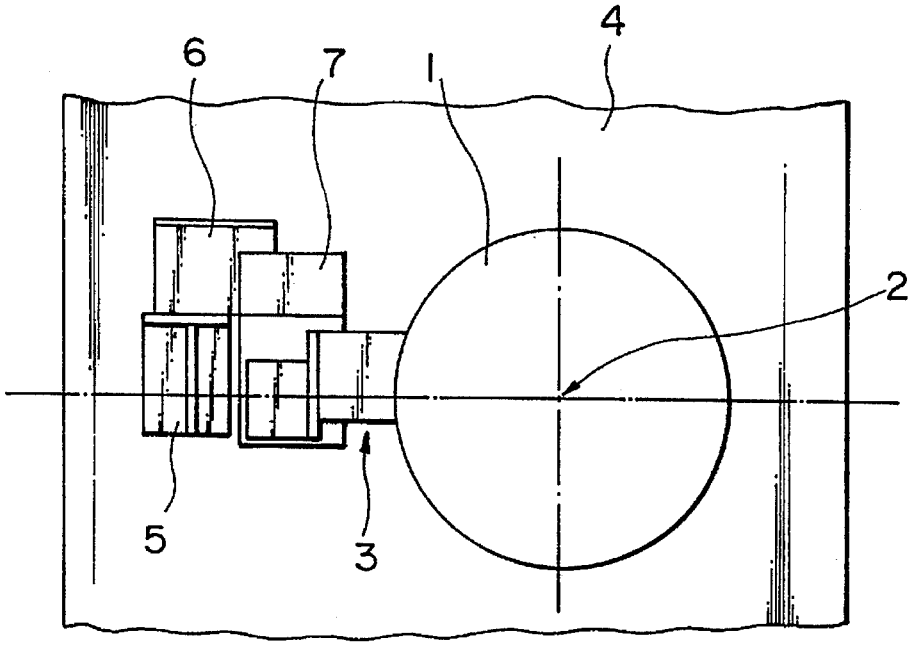
FIG. 7 is an enlarged cross-sectional view taken along B—B line of FIG. 6.

Next, with reference to FIGS. 5–9, Example 2 the third embodiment of the present invention in a printing machine of sheet feed type will be explained. It is to be noted that, since FIGS. 5–7 are almost the same as FIGS. 1–3 of the Example 1, explanations of the construction thereof are omitted and the same reference numerals are used as in FIGS. 1–3.

The interior of the cleaning case 9 is partitioned into the front 26 and the rear 27 with respect to the direction of the rotation of the printing cylinder 1, with the front 26 being fitted with or occupied by a cleaning member 28 consisting of sponge, or the like, and the rear 27 being fitted with a lip 29 composed of an elastomeric material such as hard rubber. Between the lip 29 and the front 26 and beneath the rear 27 there are formed an upper slit 30 and a lower slit 31, which possess suitable clearance, and both of them communicate with said wind chest 10. Further, beneath the lower slit 31, there is provided a lower lip 32 for the prevention of the flowing in of the air from under so as to be adjustable by means of a holding-down metal fitting, etc.

At the upper part of the above-described cleaning case 9 there is provided a cleaning liquid supply port 33, and the cleaning liquid sent from the cleaning liquid supplying device (not shown in the figure) is supplied to the cleaning member 28 through said cleaning liquid supply port 33 from supply nozzles 34. Thus, the foreign matter such as ink, paper dust, powder, etc. introduced in the cleaning head 3, and adhered to the surface of the printing cylinder 1, can be cleaned by this cleaning liquid.

Figure 8:
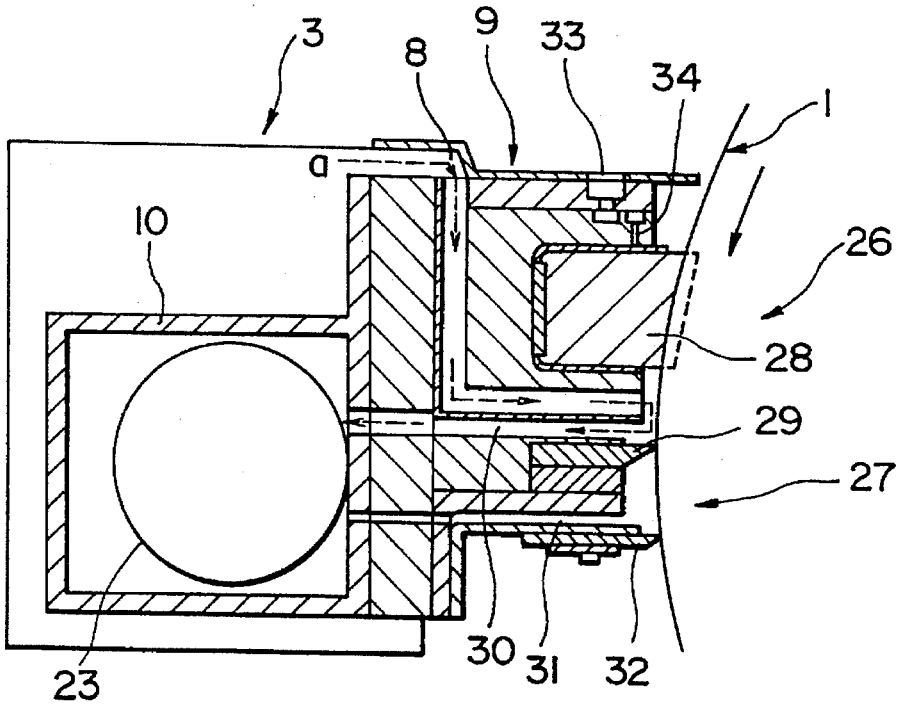
FIG. 8 is an enlarged cross-sectional view of the cleaning head in FIG. 7.
Figure 9:
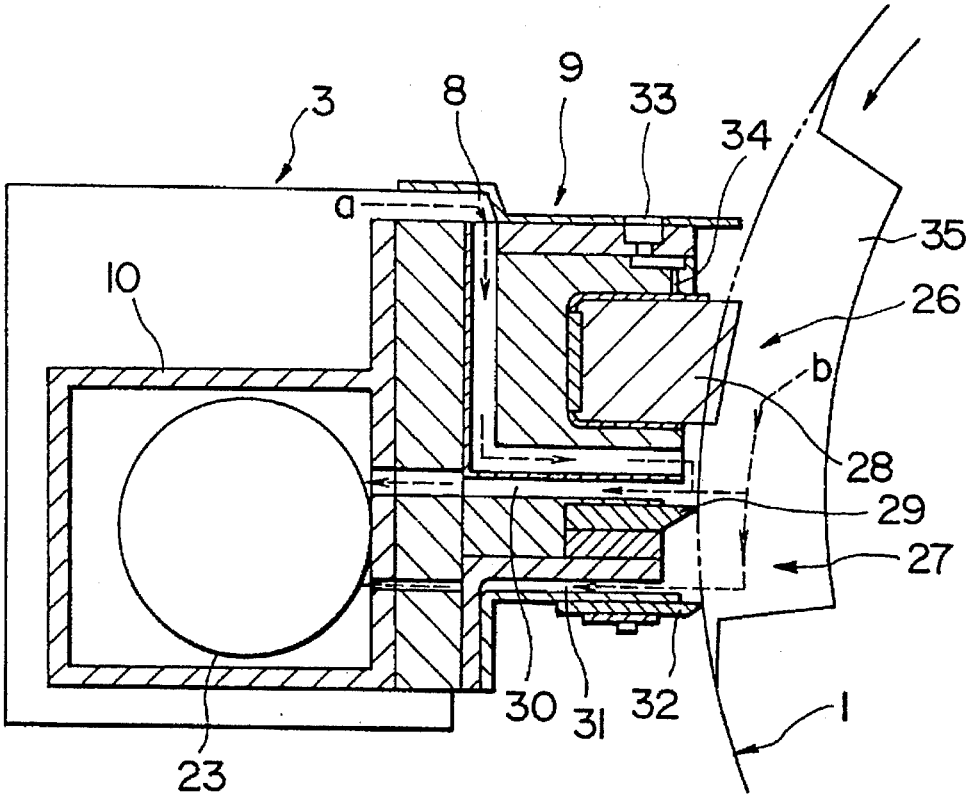
FIG. 9 is an explanatory drawing showing the stream of the air at the time when the lip passes through the gap of the printing cylinder in Example 2 of an apparatus for cleaning printing cylinder.

Next, the operation of Example 2 will be explained. The operation of Example 2, as compared with that of Example 1, shows that the stream of the air flowing in differs partially since the lower lip 32 is provided at the rear 27 instead of the cleaning member. For this reason the discharging mechanism of the waste cleaning liquid also varies. With reference to FIGS. 8 and 9 the stream of the air within the cleaning head 3 will be explained. As shown in FIG. 8, when the cleaning is being carried out while the lip 29 is in contact with the printing cylinder 1, the stream of the air, as shown by the arrow of broken line in FIG. 8, flows in only through the part a (suction port 8), and the waste cleaning liquid is transported by air through the upper slit 30 to the wind chest 10. On the other hand, the stream of the air flowing in from beneath the cleaning case 9 is hampered by the lower lip 32, so that the stream of the air becomes almost nil. FIG. 9 shows the state of the lip 32 at the time when it passes through the gap 35 of the printing cylinder 1. The stream of the air flowing in from the part a (suction port 8) is the same as in FIG. 8, but when it enters the position of the gap 35, the surrounding atmospheric air is made to flow in the upper slit 30 and the lower slit 31 from both sides of the gap 35, too, as shown by the arrow b. Thus, the greater part of the waste cleaning liquid scraped off by the lip 30 is transported by air through the upper slit 30 to the wind chest 10, and one portion of the waste cleaning liquid leaked from the front end of the lip 29 is also transported by air to the wind chest 10, being carried by the stream of the air generating within the lower slit 31 when passing through the above-described gap. This stream contributes to the removal of the cleaning liquid remaining at the ends of the gap, as well as to the reduction of the amount of the cleaning liquid remaining on the surface of the printing cylinder. And the waste cleaning liquid sucked from within the wind chest 10 by the above-described vacuum apparatus is recovered by the waste liquid recovering device (not shown in the figure).

In the above-described Example 2, explanation is given to the case of the printing machine of sheet feed type, but it is also applicable to the case of the printing machine of rotary type, in which case, however, the clearance between the lower lip 32 and the printing cylinder 1 should not be fully closed, and a small gap should not be fully closed, and a small clearance should preferably be left therebetween.

Figure 10:
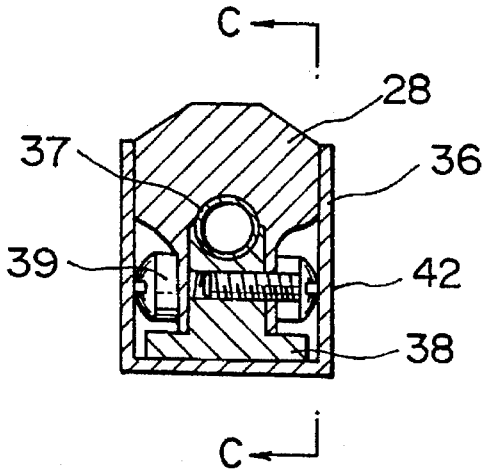
FIG. 10 is a cross-sectional view showing the cleaning liquid supplying means in Example 3 of an apparatus for cleaning printing cylinder.
Figure 11:
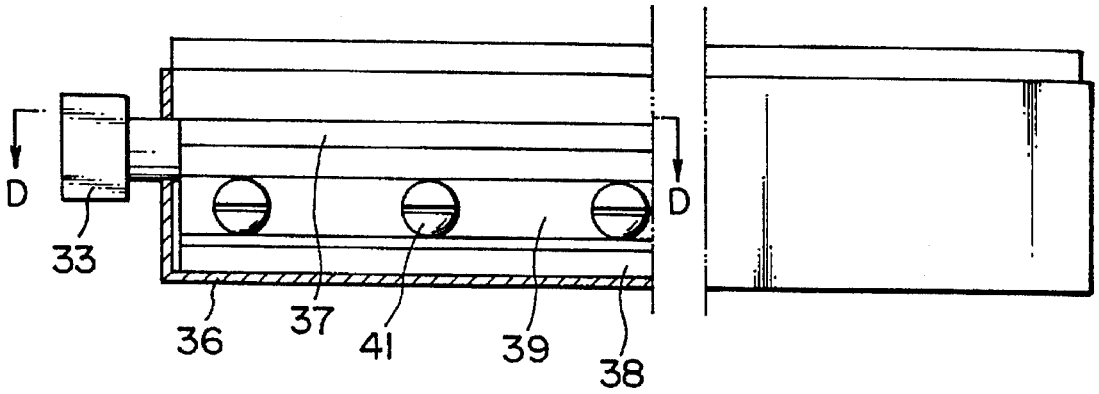
FIG. 11 shows a cross-sectional view taken along C—C line of FIG. 10 on the left and a side view in FIG. 10 on the right.
Figure 12:
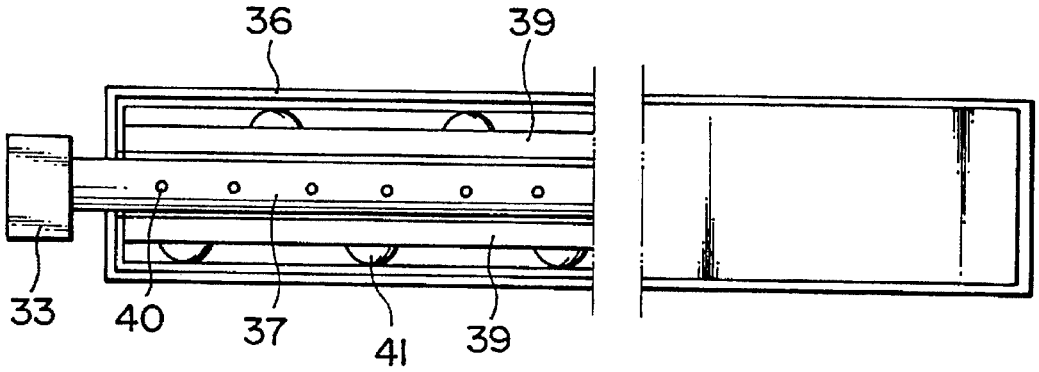
FIG. 12 shows a plane view taken in the direction of the arrow along D—D line of FIG. 11 on the left and a plane on the right.

Next, with reference to FIGS. 10–12, Example 3 the fourth embodiment will be explained. Cross-section of the front 26 in FIG. 8 is shown in FIG. 10. As shown in FIG. 10, said front 26 comprises a cleaning member 28, a sponge case 36 housing said cleaning member 28, and the above-described cleaning liquid supplying means. The cleaning liquid supplying means and the supply tube 37, circular in cross section, for supplying the cleaning liquid to said cleaning member 28 comprise a holding metal fitting 38 for holding said supply tube 37 and a clamping metal fitting 39 for fitting the cleaning member 28. Said supply tube 37 is composed of an elastomeric material such as rubber, etc. and has a large number of nozzle holes 40, very fine in diameter (about 0.2 mm or less) which are drilled at definite intervals in a single row or a plurality of rows throughout the overall width of the printing cylinder 1 on the widthwise side of the printing cylinder 1. Said supply tube 37 is held by said holding metal fitting 38 and the bottom part of said holding metal fitting 38 is fixed to said sponge case 36 by means of bolts, etc. The end of said cleaning member 28 is fixed by means of clamping bolts 41 of the clamping metal fitting 39 in the form covering said holding metal fitting 38. At one end of said supply tube 37 there is provided a cleaning liquid supply port 33 and the cleaning liquid is supplied from the cleaning liquid supply unit (not shown in the figure).

Next, the operation of Example 3 will be explained. The cleaning liquid supplied from the cleaning liquid supply unit is introduced in the supply tube 37 through the supply port 33. Said supply tube 37 expands by the supply pressure of the cleaning liquid and as the result the nozzle holes 40 are also enlarged, and thereby the injection of the cleaning liquid is performed. When the supply of the cleaning liquid is stopped, the pressure within said supply tube 37 decreases, and said supply tube 37 contracts to the original state, so that the nozzle holes also become small, and the supply of the cleaning liquid stops.

What is claimed is:

1. An apparatus for cleaning a rotating printing cylinder of a printing machine, the cleaning being carried out by pressing against a surface of the rotating printing cylinder a cleaning head which is disposed in parallel to the central axis of said printing cylinder and arranged to contact said printing cylinder along the overall width thereof; said apparatus comprising:

said cleaning head having a wind chest, at least two cleaning members for supplying a cleaning liquid to said printing cylinder and at least one lip for scraping off waste cleaning liquid from said printing cylinder, said cleaning head further comprising a cleaning case and a suction port, the interior of said cleaning case being partitioned into a front, a rear, and a middle part with respect to the direction of rotation of the printing cylinder, with said front part and said rear part each fitted with one of said cleaning members and said middle part being fitted with said lip for pressing said cleaning head against the surface of said printing cylinder along a front end of said lip, said cleaning case having slits communicating with said wind chest for discharging waste cleaning liquid scraped off said printing cylinders by said lip, said slits comprising upper and lower slits, said upper slit located between said lip and said front part, and said lower slit located beneath said rear part;

means for pressing said cleaning head against the surface of said printing cylinder along a front end of said lip;

means for supplying the cleaning liquid to said cleaning members of said front and rear parts; and means for causing air flow from both said suction ports and from beneath said cleaning case.

2. The apparatus for cleaning a printing cylinder of a printing machine as defined in claim 1, wherein said means for supplying a cleaning liquid to said cleaning member includes a supply tube of elastomeric material, said tube having nozzle holes at intervals therealong, such that an increase in a supply pressure of the cleaning liquid in said tube expands said tube and enlarges said nozzle holes to regulate the amount of cleaning liquid supplied to said cleaning members.

3. An apparatus for cleaning a printing cylinder of a printing machine, wherein the cleaning is carried out by pressing against a surface of the rotating printing cylinder a cleaning head which is disposed in parallel to the central axis of said printing cylinder and arranged to contact said printing cylinder along the overall width thereof; said apparatus comprising:

said cleaning head having a wind chest, a least one cleaning member for supplying a cleaning liquid to said printing cylinder and lips for scraping off waste cleaning liquid from said printing cylinder, said cleaning head further comprising a cleaning case and a suction port, the interior of said cleaning case being partitioned into a front part and a rear part with respect to a direction of rotation of said printing cylinder, with said front part being fitted with a said cleaning member and said front part and said rear part both being fitted with one of said lips, said cleaning case including an upper slit and a lower slit both communicating with said wind chest for discharging waste cleaning fluid scraped off said printing cylinders by said lip, said upper slit located between said lip of said rear part and said front part and said lower slit located beneath said rear part;

means for pressing said cleaning head against the surface of said printing cylinder along a front end of said lips;

means for supplying the cleaning liquid to said cleaning member of said front part; and means for causing air to flow from said suction port.

4. The apparatus for cleaning a printing cylinder of a printing machine as defined in claim 3 wherein said means for supplying the cleaning liquid to said cleaning member includes a supply tube of elastomeric material, said tube having nozzle holes at intervals therealong, such that an increase in a supply pressure of the cleaning liquid in said tube expands said tube and enlarges said nozzle holes to regulate the amount of cleaning liquid supplied to said cleaning members.

* * * * *